United States Patent [19]

Weidler

[11] 4,392,701

[45] Jul. 12, 1983

[54] TAP CONNECTOR ASSEMBLY

[75] Inventor: Charles H. Weidler, Lancaster, Pa.

[73] Assignee: AMP Incorporated, Harrisburg, Pa.

[21] Appl. No.: 319,346

[22] Filed: Nov. 9, 1981

Related U.S. Application Data

[63] Continuation-in-part of Ser. No. 170,199, Jul. 16, 1980.

[51] Int. Cl.[3] ..... H01R 11/32; H01R 13/512

[52] U.S. Cl. ..... 339/17 R; 339/97 R; 339/156 R; 339/157 R

[58] Field of Search ..... 339/156 R, 17 R, 97 R, 339/97 P, 157 R

[56] References Cited

U.S. PATENT DOCUMENTS

| | | | |
|---|---|---|---|
| 3,760,335 | 9/1973 | Roberts | 339/99 R |
| 3,866,292 | 2/1975 | Tucci | 29/749 |
| 3,866,295 | 2/1975 | Tucci | 29/749 |
| 3,902,154 | 8/1975 | McKee | 339/103 R |
| 3,963,300 | 6/1976 | Patton et al. | 339/156 R |
| 4,002,392 | 1/1977 | Hardesty | 339/99 R |
| 4,210,376 | 7/1980 | Hughes et al. | 339/17 LC |
| 4,220,391 | 9/1980 | Krolak et al. | 339/126 R |
| 4,236,779 | 12/1980 | Tang | 339/143 R |
| 4,261,629 | 4/1981 | Reynolds et al. | 339/98 |
| 4,290,664 | 9/1981 | Davis et al. | 339/156 R |
| 4,296,991 | 10/1981 | Hughes et al. | 339/176 MP |
| 4,315,664 | 2/1982 | Hughes et al. | 339/176 M |
| 4,355,853 | 10/1982 | Kourimsky | 339/17 R |

OTHER PUBLICATIONS

Suttle "Super Tap Sandwich Connector", Suttle Apparatus Corporation.
TRW Data Sheet, PBC 249.
TRW Cinch Connectors, Part No. 299-24-00-020.
TRW Cinch Connectors, Data Sheet, Super Mod V Telephone Adapter System.

*Primary Examiner*—John McQuade
*Assistant Examiner*—Gary F. Paumen
*Attorney, Agent, or Firm*—Frederick W. Raring

[57] ABSTRACT

Tap connector assembly comprises a housing having standard cable connectors mounted in its sidewalls in back-to-back relationship. A circuit board is contained in the housing and wire conductors extend from the terminals in the standard cable connectors across the surface of the circuit board to connect corresponding terminals in the connectors to each other. A plurality of displation type terminals are mounted in the circuit board and selected conductors extending between the standard cable connectors are inserted into the slots in the displation connectors. The displation connectors have integral solder posts which are soldered to circuit board conductors on the underside of the circuit board. The circuit board conductors extend to solder posts on modular jacks which are mounted on the circuit board adjacent to its end edges. The plug receiving openings in the jacks are accessible from the outside of the housing. Standard cable connectors on the ends of cables are mated with the standard cable connectors in the assembly and modular plugs on the ends of tap cables are inserted into the modular jacks in the tap connector assembly.

8 Claims, 6 Drawing Figures

Fig. 3
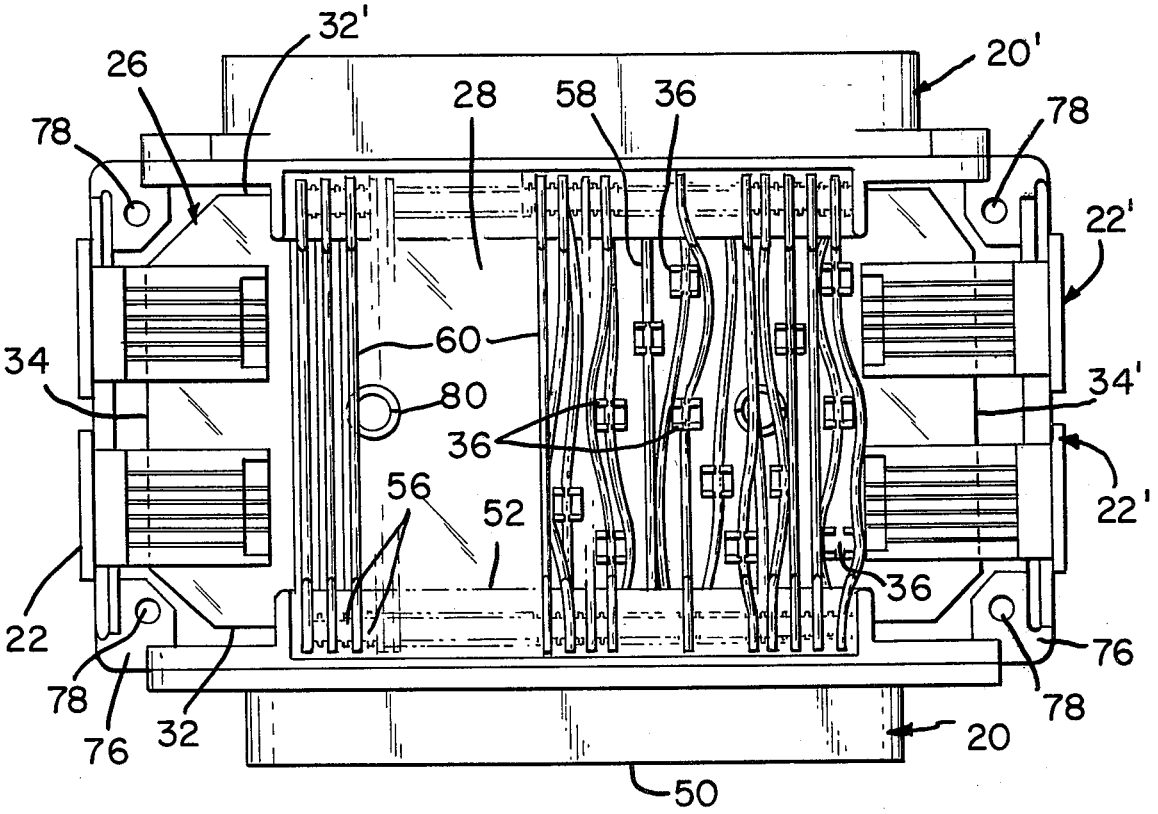
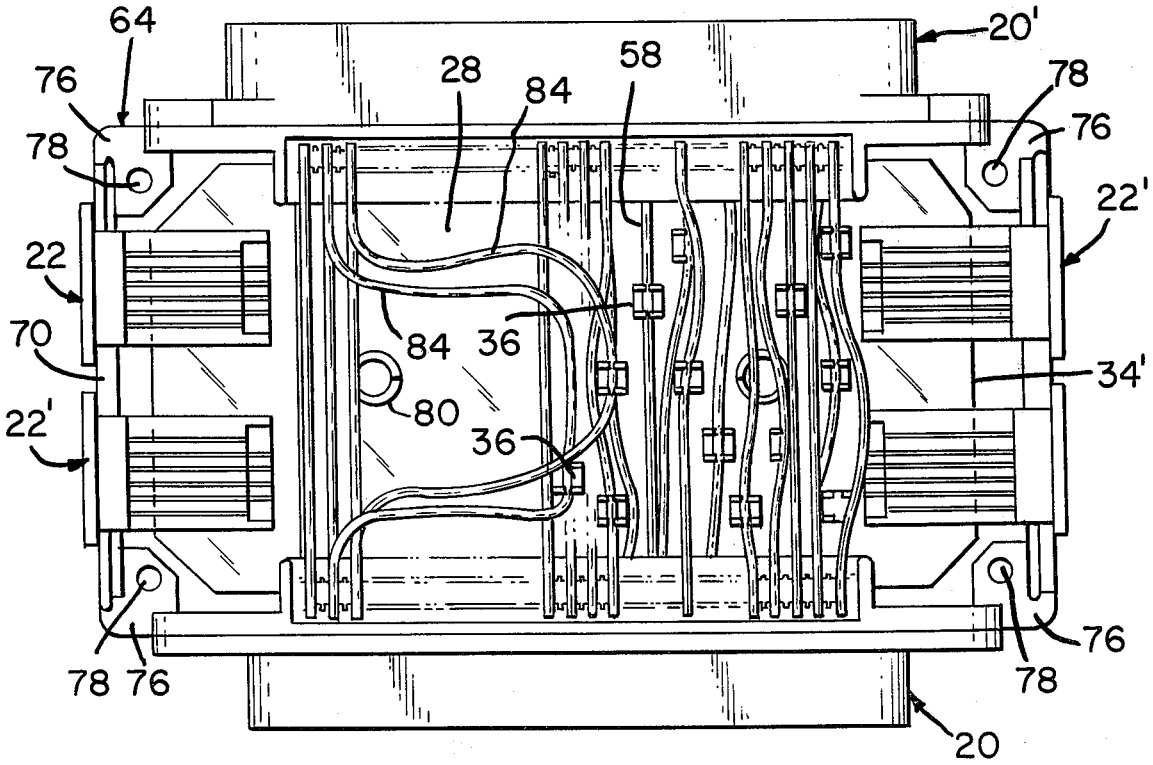
Fig. 4

TAP CONNECTOR ASSEMBLY

This application is a continuation-in-part of Ser. No. 170,199 filed July 16, 1980.

FIELD OF THE INVENTION

This invention relates to tap connector assemblies of the type used to form tap connections to conductors in a standard communications type cable. The tap connector assembly makes use of standard cable connectors and modular jack type receptacle connectors which are widely used in the communications industry and in related industries.

It is frequently required that tap connections be made to the conductors in multi-connector cables of the type used in the telephone industry. Such cables usually have 25 pairs of conductors therein and, when top connections are required, it is usually necessary to make tap connections to four or more pairs of the conductors in the cable. A number of adaptors have been proposed for making such tap connections. These known adaptors are made up of a type of cable connector, herein referred to as a standard cable connector, and modular jacks of the general type shown in U.S. Pat. No. 4,210,376. Typical standard cable connectors are shown in U.S. Pat. Nos. 3,902,154 and 3,760,335. Connectors of this type are readily available and are all dimensioned so that they can be coupled whether or not they are produced by one manufacturer. In other words, modular jacks and cable connectors are manufactured to an industry standard which ensures intermateability among components from different sources.

The present invention is directed to the achievement of an improved tap connector assembly which can be manufactured with relative ease from standard known parts that are available from a variety of sources. The invention is further directed to the achievement of a compact tap connector assembly which can be easily modified to form tap connectors with any of the pairs of wires in a multi-connector cable and which can, if desired, be modified by the user at the time the tap connect or assembly is put to use.

A tap connector assembly in accordance with the invention is of the type comprising first and second standard cable connectors, each cable connector comprising an insulating housing having a mating face, a rearward face and a plurality of cable connector terminals in the housing. The cable connector terminals are arranged in two parallel rows which extend between the endwalls of the connector housing and the terminals have wire connecting portions adjacent to the rearward face of the housing. The standard cable connectors are in spaced apart back-to-back relationship and the corresponding terminals in the two cable connectors are connected to each other by wire conductors which extend between, and have their ends connected to, the corresponding cable connector terminals. The assembly also includes one or more modular jacks and a selected plurality of the first conductors which extend between the cable connectors are connected to jack conductors in the modular jack. A tap connector in accordance with the invention is characterized in that the standard cable connectors are located along the opposite side edges of a circuit board and the first conductors extend across one surface of the circuit board. A plurality of insulation displacement terminals are mounted in the circuit board, each terminal having a wire connecting portion which has a wire receiving slot and a solder post extending from the wire connecting portion. The wire connecting portions of the insulation displacement terminals extend normally from the one surface of the circuit board and the solder posts extend through holes in the circuit board and from the other surface of the circuit board. The modular jack is mounted on the one surface of the circuit board adjacent to one of the end edges and the conductors in the modular jack have solder post portions which are soldered to circuit board conductors on the underside of the circuit board. The circuit board conductors extend between the solder posts of the insulation displacement terminals and the solder posts of the conductors in the modular jack. The selected first conductors to which tap connections are to be made are inserted into the wire receiving slots of the insulation displacement terminals.

In accordance with further embodiments of the invention, the circuit board is contained in an assembly housing and the standard cable connectors and the modular jacks are mounted in the walls of the housing.

DRAWINGS

FIG. 3 is a plan view of the assembly with one half the housing removed to expose the manner in which the first conductors are connected to the insulation displacement terminals.

FIG. 4 is a view similar to FIG. 3 of an alternative embodiment.

PREFERRED EMBODIMENT

Figure 1:
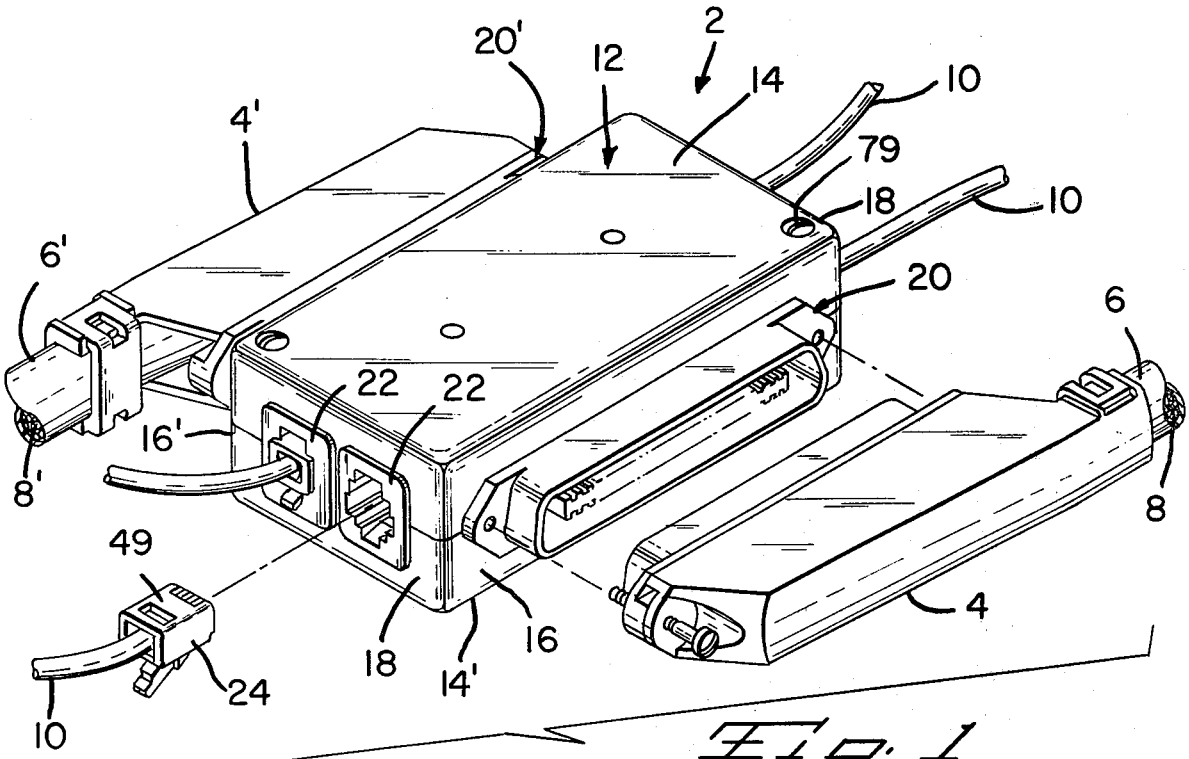
FIG. 1 is a perspective view of a tap connector assembly in accordance with the invention coupled to cable connectors and having modular plugs on the ends of tap cables inserted into the modular jacks of the assembly.
Figure 2:
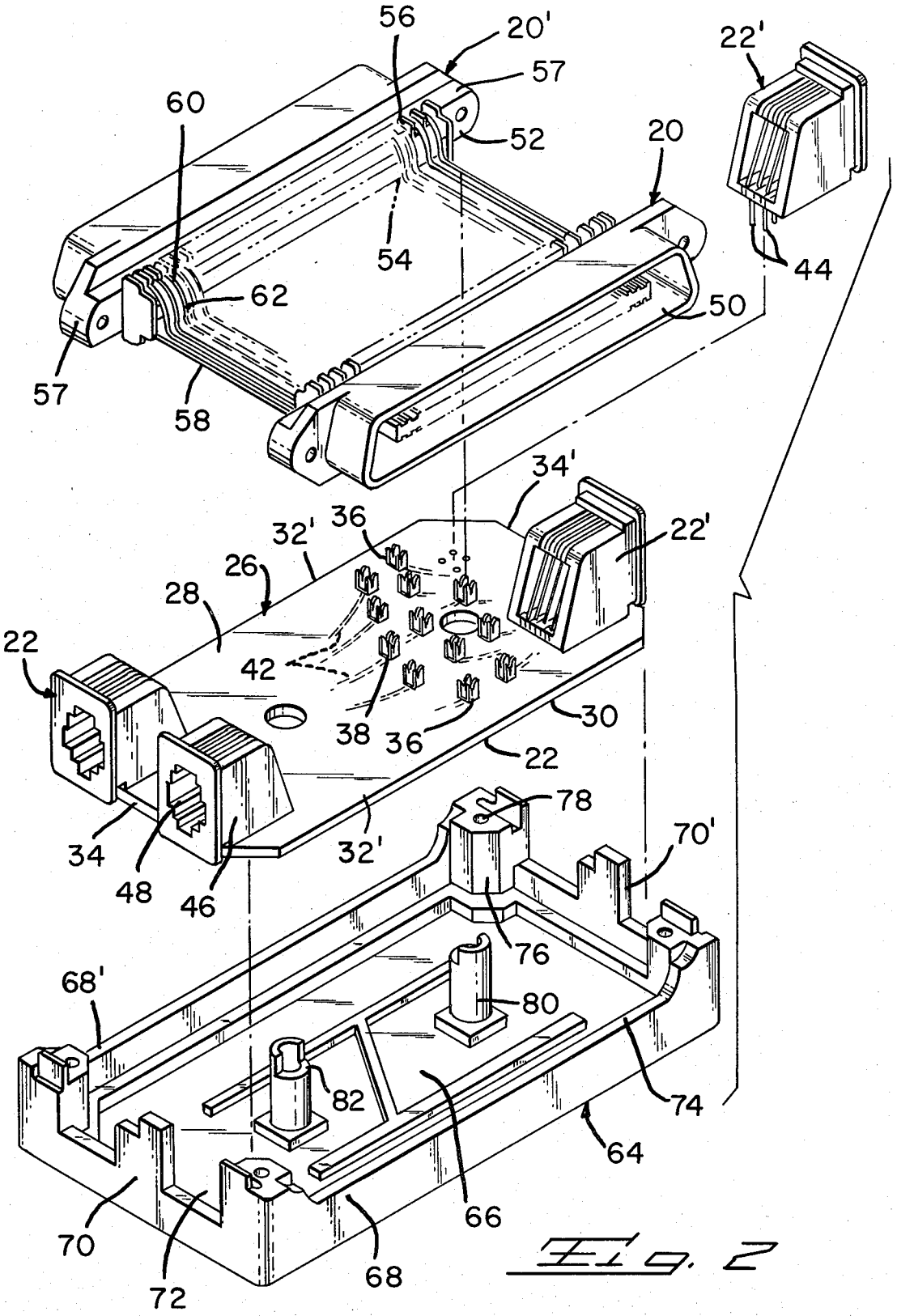
FIG. 2 is a perspective exploded view showing the parts of the tap connector assembly.

Referring first to FIGS. 1–3, a tap connector assembly 2 in accordance with the invention, is used to make tap connections to cable conductors 8, 8' in cables 6, 6' which have standard cable connectors 4, 4' installed on their ends. The tap conductors are contained in cables 10 which have modular plugs 24 installed on their ends. Modular plugs of the type shown at 24 are fully described in U.S. Pat. No. 4,002,392 and are coming into widespread use in the telephone industry for telephone equipment and related uses.

The tap connector assembly 2 comprises a plastic assembly housing 12 having upper and lower major rectangular surfaces 14, 14', sidewall surfaces 16, 16', and endwall surfaces 18, 18'. First and second standard cable connectors 20, 20' are mounted in the sidewall surfaces 16, 16' and modular jacks as shown at 22, 22', are mounted in the endwall surfaces 18, 18'. The standard cable connectors 4, 4' and 20, 20' are of a type well known and widely used in the communications industry and are produced by several different manufacturers. U.S. Pat. Nos. 3,902,154 and 3,760,335 show standard cable connectors which are not identical but either of which can be used in a connector assembly in accordance with the present invention. The modular jacks 22 may be of the type described in U.S. Pat. No. 4,210,376.

As shown in FIG. 2, the housing contains a rectangular circuit board 26, one surface 28 of which is the upper surface in this drawing and the other surface 30 is the downwardly directed surface. The circuit board has parallel side edges 32, 32' and parallel end edges 34, 34'.

Figure 5:
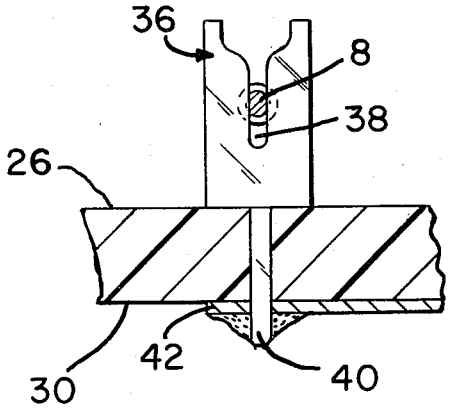
FIG. 5 is a fragmentary view of an insulation displacement terminal.

A plurality of insulation displacement terminals 36, FIG. 5, are mounted in holes in the circuit board 26 and have wire connecting portions which extend from the surface 26 of the circuit board. The wire connecting portions have slots 38 which receive wires and which establish electrical contact with the insulating cores of the wires upon insertion of the wires into the slots. Each terminal 36 also has a post portion 40 which extends beyond the lower surface 30 of the circuit board and is soldered to one of several circuit board conductors 42 on the underside of the circuit board.

The insulation displacement terminals may be of the type shown in U.S. Pat. No. 4,261,629 or may be of alternative types having the capability of establishing contact with wires upon insertion of the wire into a slot.

The modular jacks 22 each comprises an insulating housing having a plug receiving opening 48 extending into its plug receiving face. Modular jack conductors contained in the jack housing establish contact with exposed contacts on the upper surface 49 of the plug 24 and these conductors have integral solder posts 44 which, as previously mentioned, extend through the circuit board and are soldered to the conductors 42 on the underside of the circuit board 26.

Each of the standard cable connectors 20, 20' has a mating face 50, a rear face 52, and terminals therein which extend through the connector housing from the mating face to the rear face. The terminals have wire receiving portions at their rearward ends containing slots so that wires 58, 60 can be connected to the terminals by moving the wires into the slots.

The terminals are arranged in a lower row 54 and an upper row 56, these two rows extend parallel to each other between the ends 57 of the connector housing. A plurality of first conductors, or through conductors, 58 extend between corresponding terminals in the lower rows 54 of terminals in the connectors 20, 20' and a like plurality of first conductors 60 extend between corresponding terminals in the second or upper rows 56 of the connectors. The conductors 60 are dressed downwardly as shown at 62 in FIG. 2, so that all of these first or through conductors are coplanar or nearly so.

In assembling the standard cable connectors 20, 20' to the circuit board, the cable connectors and the conductors 58, 60 are moved downwardly from the position of FIG. 2 until the cable connectors are disposed along the edges 32, 32' of the circuit board. Thereafter, selected conductors 58, 60 to which tap connections are to be made, are inserted into the wire receiving slots 38 of the insulation displacement terminals 36 as shown in FIG. 3. The insertion operation can be carried out with a simple hand tool which accurately pushes the wires into the slots, the insulation is pierced and electrical contact is established. As shown in FIG. 3, it is necessary to dress some of the wires laterally from their normal straight-line paths in order that they will clear the terminals 36 mounted on the circuit board. A slight amount of slack in the wires is required to permit the wires to be routed around the terminals in this manner.

The precise wires 58, 60 which are connected to the terminals 36 will be determined by the tap connections required. Each of the terminals in the standard cable connectors 20, 20' will be mated with its counterpart in the connectors 4, 4' and the terminals in these connectors will in turn be connected to predetermined conductors 8, 8' in the cables 6, 6'. It is apparent then that any preselected conductors 8, 8' in the cables can be tapped and connected to any one of the four jacks 22, 22'.

In the embodiment of FIGS. 1–3, the insulation displacement terminals are clustered on a portion of the circuit board which is proximate to the end edge 34'. This embodiment then is best adapted to establish tap connections with those conductors 58, 60 which are on the right in FIG. 2.

After selected conductors 58, 60 have been inserted into the insulation displacement terminals 36, the assembly is functionally complete and it is then mounted in the housing 12 which is comprised of two identical housing parts 64. Each housing part comprises a rectangular panel 66 having parallel sidewall flanges 68, parallel endwall flanges 70, and centrally located columns 80 which are cut away at their upper ends 82. The sidewall flanges have recesses 72 therein, which receive portions of the housings 46 of the jacks so that the flanges on the faces of these jack housings are on the outside of the housing assembly 12. The flanges 68 have similar recesses 74 which receive the standard cable connectors 20, 20'. The corners 76 of the housing part 64 have fillets which have screw holes 28 so that when the two parts are assembled to each other, they can be secured to each other by screws 79. Additional fasteners can be inserted through the hollow cylindrical columns 80, if desired.

It will be apparent that the principles of the invention permit the achievement of an extremely compact tap connector assembly which can be readily manufactured from commonly available connectors and terminals. The formation of the final electrical connections to the insulation displacement terminals is carried out with a simple hand tool, as noted above, and the connection of the wires 58, 60 to the terminals in the standard cable connectors 20, 20' can be carried out with connecting devices of the general type shown in U.S. Pat. Nos. 3,866,295 and 3,886,292.

As shown in FIG. 4, it is possible to make tap connections to selected wires 58, 60 which are adjacent to the lefthand end of the circuit board, as well as wires which are on the righthand portion of the circuit board. To make connections to terminals in the lefthand portions of the standard cable connectors, longer wires are used, as shown at 84, and these wires are dressed laterally to the desired insulation displacement terminals 36, and are inserted into the terminals and then dressed laterally to their appropriate terminals in the standard cable connectors.

If desired, the insulation displacement terminals can be located at uniform intervals between the ends 34, 34' of the circuit board and all of the tap connections to the wires 58, 60 can be made by dressing the wires laterally as indicated at 84. In other words, no attempt would be made to locate the terminals 36 adjacent to the wires to which they are to be connected. With this arrangement, the user could determine which of the conductors 58, 60 should have tap connections made thereto. To make a tap connection to a given wire, he would remove the relatively short wire 58 or 60 in the assembly shown in FIG. 2 and substitute a longer length of similar wire capable of extending to the insulation displacement terminal 36.

Figure 6:
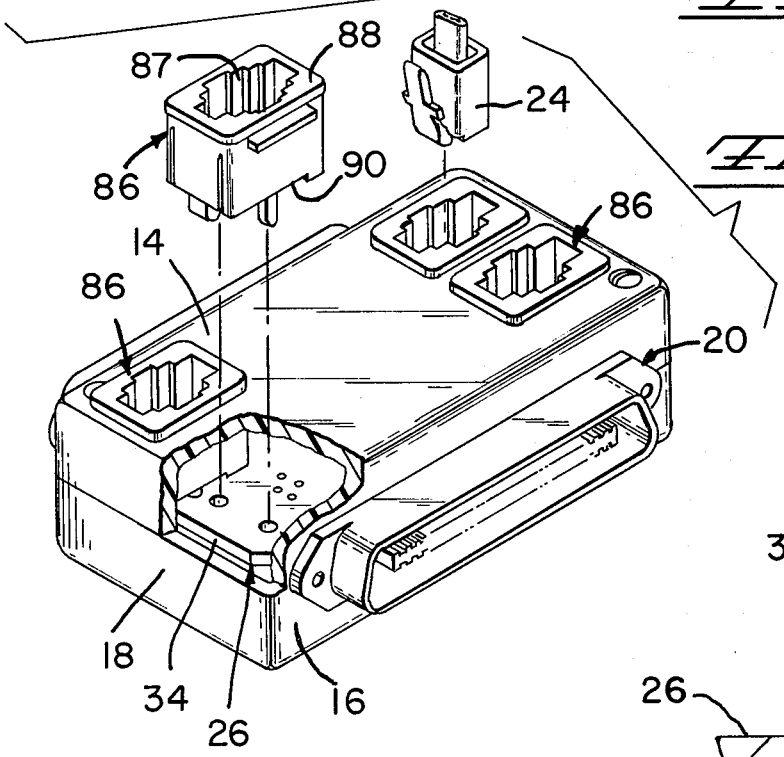
FIG. 6 is a perspective view of a further embodiment.

FIG. 6 shows an alternative embodiment in which the modular jacks 86 are of a type shown in U.S. Pat. No. 4,296,991. The modular jack 86 has its plug receiving opening 87 extending into an upper face 88 which is parallel to the base 90. The solder post portions of the conductors in the jack 86 extend from the base 90 and it is assembled to the circuit board, as previously described. In this embodiment then, the openings in the jacks are coplanar with the major surface 14 of the housing, an arrangement which may be preferable under some circumstances.

I claim:

1. A tap connector assembly for making tap connections to selected conductors in a multi-conductor cable, the tap connector assembly being of the type comprising first and second standard cable connectors, each cable connector comprising an insulating housing having a mating face and a rearward face, a plurality of cable connector terminals in the housing, the cable connector terminals being arranged in two parallel rows which extend between the endwalls of the housing, the cable connectors being in spaced-apart back-to-back relationship with their rearward faces in opposed relationship, the corresponding cable connector terminals in the first and second cable connectors being connected to each other by first conductors which extend between, and have their ends connected to, the corresponding cable connector terminals, at least one modular jack, a selected plurality of the first conductors being connected intermediate their ends to jack conductors in the modular jack, the tap connector assembly being characterized in that:

the standard cable connectors are located along the opposite side edges of a circuit board, the first conductors being wires which extend across one surface of the circuit board, a plurality of insulation displacement terminals are mounted in the circuit board, each insulation displacement terminal having at least one wire connecting portion having a wire-receiving slot therein and having a solder post extending from the wire connecting portion, the wire connecting portion extending normally from the one surface of the circuit board and the solder posts extending through holes in the circuit board and from the other surface of the circuit board, the modular jack being mounted on the one surface of the circuit board adjacent to one of the end edges thereof, the jack conductors having solder post portions extending from the housing in the modular jack through holes in the circuit board and beyond the other surface of the circuit board, a plurality of circuit board conductors which extend between the solder post portions of the jack conductors and the solder post portions of the insulation displacement terminals, the circuit board conductors being soldered to the post portions, and the selected first conductors having intermediate portions thereof inserted into the wire receiving slots of the insulation displacement terminals whereby, upon coupling standard cable connectors on the ends of cable sections to the first and second standard cable connectors in the tap connector assembly and thereafter plugging a modular plug on the end of a tap cable into the modular jack, the conductors in the tap cable are connected to preselected cable conductors.

2. A tap connector assembly as set forth in claim 1, characterized in that the first and second standard cable connectors, the modular jack, and the circuit board are enclosed in a housing having oppositely directed major surfaces, oppositely directed sidewall surfaces and oppositely directed endwall surfaces, the standard cable connectors extending through the sidewall surfaces, the modular jack extending through one of the remaining surfaces.

3. A tap connector assembly as set forth in claim 2 characterized in that the modular jack extends through one of the endwall surfaces.

4. A tap connector assembly as set forth in claim 2 characterized in that the modular jack extends through one of the major surfaces of the housing.

5. A tap connector assembly as set forth in either of claims 1 or 2 characterized in that the first and second standard cable connectors each has one row of cable connector terminals which is adjacent to the one surface of the circuit board and a second row of cable connector terminals therein which is parallel to and spaced from, the one surface of the circuit board, the first conductors which extend between corresponding terminals in the second row being dressed towards the one surface of the circuit board and being substantially coplanar with the first conductors which extend between corresponding terminals in the one row.

6. A tap connector assembly as set forth in claim 5 characterized in that a plurality of modular jacks are mounted on the one surface of the circuit board adjacent to at least one of the side edges thereof.

7. A tap connector assembly as set forth in claim 6 characterized in that the first conductors extend along straight line paths across the one surface of the circuit board, each insulation displacement terminal being in alignment with the first conductor which is inserted into its wire-receiving slot.

8. A tap connector assembly as set forth in claim 6 characterized in that at least one of the first conductors extends, from the cable connector terminal in the first cable connector to which it is connected, in a first lateral direction to the selected insulation displacement terminal to which it is connected, and extends from the selected insulation displacement terminal in a second lateral direction to the corresponding cable connector terminal in the second cable connector.

* * * * *